US007059980B1

(12) United States Patent
Shannon, Jr.

(10) Patent No.: US 7,059,980 B1
(45) Date of Patent: Jun. 13, 2006

(54) TELESCOPIC SINGLES STICK

(76) Inventor: John L. Shannon, Jr., 2760 White Oak Cir., Orono, MN (US) 55356

( * ) Notice: Subject to any disclaimer, the term of this patent is extended or adjusted under 35 U.S.C. 154(b) by 747 days.

(21) Appl. No.: 09/655,054

(22) Filed: Sep. 5, 2000

(51) Int. Cl.
*A63B 61/00* (2006.01)

(52) U.S. Cl. ..... 473/494

(58) Field of Classification Search ..... 473/490, 473/492, 493, 48; 482/17, 104, 138
See application file for complete search history.

(56) References Cited

U.S. PATENT DOCUMENTS

| | | | | |
|---|---|---|---|---|
| 4,135,716 | A * | 1/1979 | Ginsburg | 473/416 |
| 4,440,393 | A | 4/1984 | Smith, Jr. | |
| 4,637,608 | A * | 1/1987 | Owens et al. | 482/138 |
| 4,638,998 | A | 1/1987 | Shannon, Jr. | |
| 4,718,671 | A * | 1/1988 | Desmond et al. | 473/48 |
| 4,830,382 | A | 5/1989 | Wheeler | |
| 4,976,432 | A | 12/1990 | Cheney | |
| 4,993,719 | A * | 2/1991 | Hernandez | 473/492 |
| 5,290,213 | A * | 3/1994 | Sheikowitz | 482/104 |
| 5,326,109 | A * | 7/1994 | Robl | 473/492 |
| 5,352,057 | A * | 10/1994 | Zody | 403/109.3 |
| 5,466,204 | A * | 11/1995 | Nearing | 482/100 |
| 5,665,038 | A * | 9/1997 | Miller | 482/104 |
| 5,737,819 | A * | 4/1998 | Sawdon et al. | 29/243.5 |
| 5,967,093 | A * | 10/1999 | Vitt et al. | 119/705 |
| 6,152,859 | A * | 11/2000 | Stearns | 482/52 |
| 6,612,533 | B1 * | 9/2003 | Biles et al. | 248/354.1 |
| 6,644,601 | B1 * | 11/2003 | Aussiker | 248/49 |

FOREIGN PATENT DOCUMENTS

| | | | |
|---|---|---|---|
| CH | 680942 | A * | 12/1992 |
| FR | 2647020 | A1 * | 11/1990 |
| JP | 200054616 | A * | 2/2000 |
| WO | WO 8102462 | A1 * | 9/1981 |

OTHER PUBLICATIONS

Juvinall, Robert C., Fundamentals of Machine Component Design, 2nd Edition, New York: John Wiley & Sons, Inc., Copyright 1991, p. 427.*

* cited by examiner

*Primary Examiner*—Eugene Kim
*Assistant Examiner*—Alvin A. Hunter, Jr.
(74) *Attorney, Agent, or Firm*—James W. Miller

(57) ABSTRACT

A singles stick is provided for raising the top edge of a tennis net from its otherwise undisturbed position to convert a tennis net from doubles to regulation singles play. The singles stick comprise a base that abuts against the ground when the singles stick is installed and an upper staff that engages against the top edge of the net when the singles stick is installed. The base and the upper staff are telescopically connected to one another to allow their combined length to be varied between an extended position and a collapsed position. In the extended position, their combined length is sufficient to raise the top edge of the net from the position that edge has during doubles play. In the collapsed position, their combined length is sufficient to allow the singles stick to be stored in an equipment bag of the type used to carry tennis rackets and the like.

10 Claims, 3 Drawing Sheets

TELESCOPIC SINGLES STICK

TECHNICAL FIELD

This invention relates to an elongated stick for adjusting the height of a tennis net. More particularly, this invention relates to a so-called singles stick used in tennis to reset the net height from that appropriate for doubles play to that required for singles play.

BACKGROUND OF THE INVENTION

Tennis is a well known game played on a standardized court. The tennis court comprises a rectangular playing area bounded by two spaced apart end lines which are connected together by side lines. Each side of the tennis court is usually provided with two parallel side lines, a singles line used for singles play and a doubles line used for doubles play. This playing area is bisected across the middle thereof by the tennis net. The tennis net can have various forms, but customarily includes a net strung under tension between two relatively permanent end posts. The end posts are most often set at a location outside of the doubles lines on the court.

Under the formal rules of tennis, as set out by the various governing bodies thereof, the tennis net must have a particular height at various points along its length. For example, the low point of the tennis net is usually at the center thereof where it is cinched by a strap fixed to the court to attain the correct height. The net slopes gradually upwardly from this center point until it reaches the end posts. As a practical matter, the height of the end posts is chosen so that when the net crosses the doubles line it will have the correct height above the ground to satisfy the rules of play for doubles. Unfortunately, this same net position used for doubles play does not satisfy the rules for regulation singles play since the height of the net as it crosses the singles line is too low.

Because it is most desirable to have a single tennis court that can be used for both singles and doubles play, the problem of adjusting the tennis net to regulation height for singles play has been solved by using what is known as a singles stick. This stick is simply an elongated member or board having a notch in the top which is jammed between the tennis net and the ground. This is usually done at a predetermined location outside the singles court with the singles stick being of a sufficient height so that it will raise the top of the net the amount necessary to convert it to regulation singles play, i.e. the height of the net above the ground at the singles line will be exactly correct. U.S. Pat. No. 4,440,393 to Smith shows a singles stick of this type. Thus, most tennis courts are built with the end posts and the net normally being set for doubles play with singles sticks being used when necessary to convert the net to regulation singles play.

While singles sticks are effective for the purpose for which they are intended, namely converting the net from doubles to singles play, known singles sticks have a number of disadvantages. For one thing, they are 42 inches long. Thus, such sticks are quite cumbersome for a tennis player to store and carry, thus discouraging their use. For example, a conventional, unitary singles stick is too long to fit into the equipment bag that most tennis players use to carry their tennis racket, tennis balls, and the like. Thus, the singles stick must be carried separately, which is obviously a disadvantage.

U.S. Pat. No. 4,976,432 to Cheney discloses a singles stick which can be assembled from a plurality of shorter sections. The sections are assembled end to end relative to one another with a dowel on the top of one section fitting via a press fit into a socket on the bottom of another section. When all the sections are assembled together, they form a singles stick having the correct length.

While making the singles stick from separate sections eases the task of carrying the singles stick in an equipment bag, the Cheney approach has its own disadvantages. First, if any one of the sections of the stick is lost or misplaced, the stick is useless since it cannot be assembled to its full length. In addition, if the stick is hit or struck by a ball, the sections making up the stick can come apart, requiring that the stick be reassembled and placed again at its proper position on the court. Moreover, assembling a plurality of sections end to end, such as the three sections of the stick shown in Cheney, can be difficult to do, particularly if the press fit between the sections becomes loose. Thus, the sections of the stick can come apart while attempting to assemble or place the stick between the net and the court.

SUMMARY OF THE INVENTION

One aspect of this invention relates to a singles stick for holding the top edge of a tennis net at its regulation height above the ground for singles play. The singles stick comprises a base and a staff which are slidably connected to one another such that the base and staff can be extended between an extended position and a collapsed position by sliding the base and staff relative to one another. The base and staff have a combined length in the extended position to properly position the tennis net for singles play when the singles stick is installed between the top edge of the net and the ground. The base and staff have a combined length in the collapsed position which is shorter than the combined length of the base and staff in the extended position. A lock is provided for releasably holding the base and staff together in at least the extended position of the base and staff.

Another aspect of this invention relates to a singles stick which comprises a plurality of telescopically received sections including at least one first, hollow section into which a second section is telescopically received such that the first and second sections can be extended between an extended orientation and a collapsed orientation by telescoping the first and second sections relative to one another. The first and second sections have a combined length in the extended orientation to properly position the tennis net for singles play when the singles stick is installed between the top edge of the net and the ground. The first and second sections have a combined length in the collapsed orientation which is shorter than the combined length of the first and second sections in the extended orientation. A lock is provided for releasably holding the base and staff together in at least the extended position of the base and staff.

Yet another aspect of this invention relates to a singles stick which comprises a base that abuts against the ground when the singles stick is installed and an upper staff that engages against the top edge of the net when the singles stick is installed. The base and the upper staff are telescopically connected to one another to allow the base and staff to be placed in an extended position and a collapsed position with the base and staff remaining connected together as they move between the extended and collapsed positions, wherein the base and staff have a combined length in the extended position which is sufficient to raise the top edge of the net from the position that edge has during doubles play.

BRIEF DESCRIPTION OF THE DRAWINGS

This invention will be described hereafter in the Detailed Description, taken in conjunction with the following drawings, in which like reference numerals refer to like elements or parts throughout.

DETAILED DESCRIPTION

Figure 1:
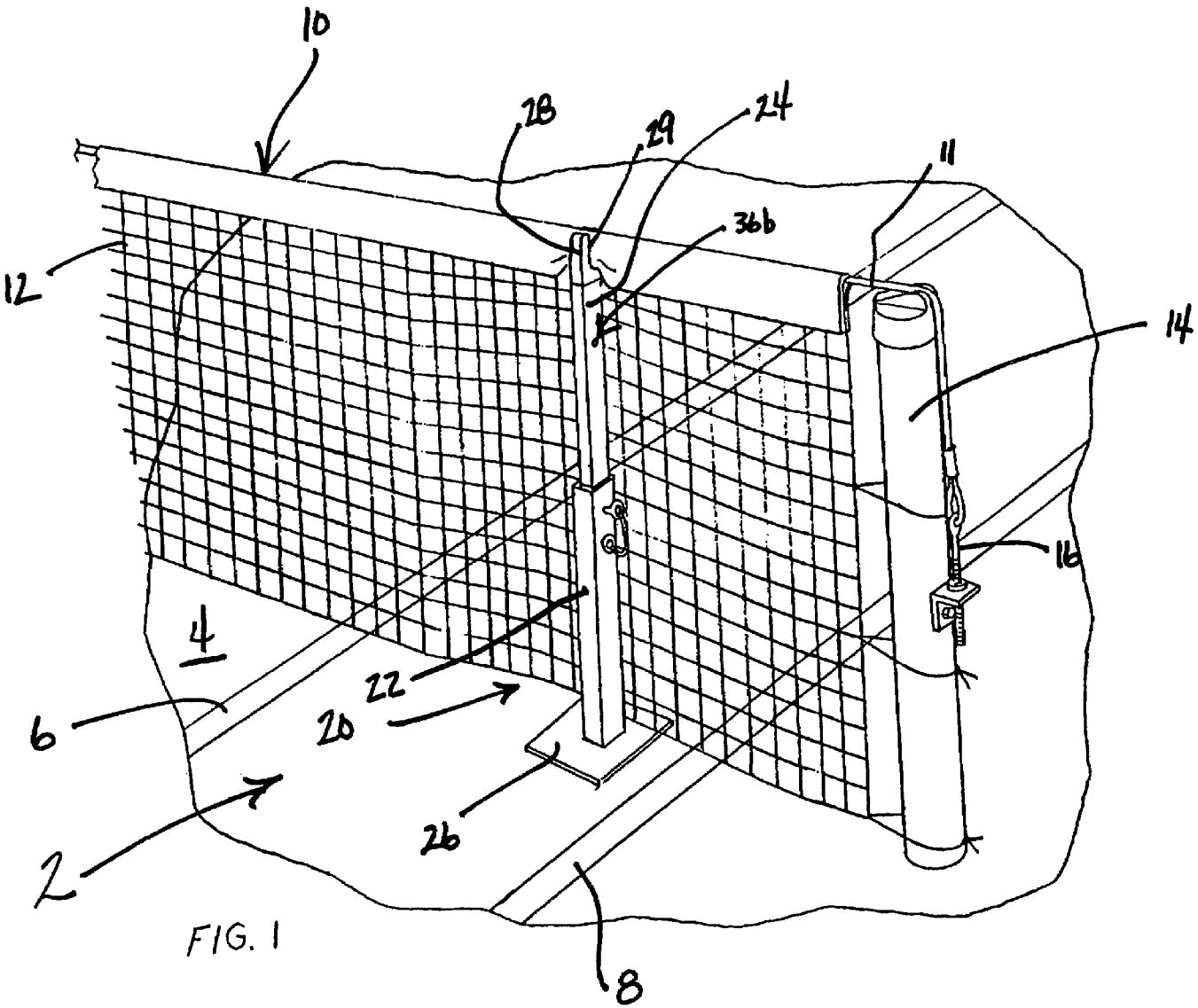
FIG. 1 is a perspective view of a first embodiment of a singles stick according to this invention, particularly illustrating the stick in it's extended operating position and with the singles stick shown spaced inwardly from the end post and wedged between the ground and the net for raising the height of the tennis net for regulation singles play.

Referring first to FIG. 1, a generally conventional tennis court is illustrated at 2. Court 2 includes a playing surface 4 each side of which includes two parallel side lines that mark the court's width, i.e. a singles line 6 and a doubles line 8. A tennis net 10 comprises a top support cord or cable 11 from which the mesh-like net fabric 12 is suspended.

Net 10 is strung between two spaced apart and generally circular end posts 14 (only one of which is shown in the drawings) in such a manner that it bisects the playing surface 4 into two equal halves. Each end post 14 is permanently mounted into the ground and is usually located outside the doubles line 8 as shown. A tensioning mechanism 16 may be included on each end post 14 for tightening net 10. In fact, cable 11 of net 10 is usually under considerable tension.

Figure 2:
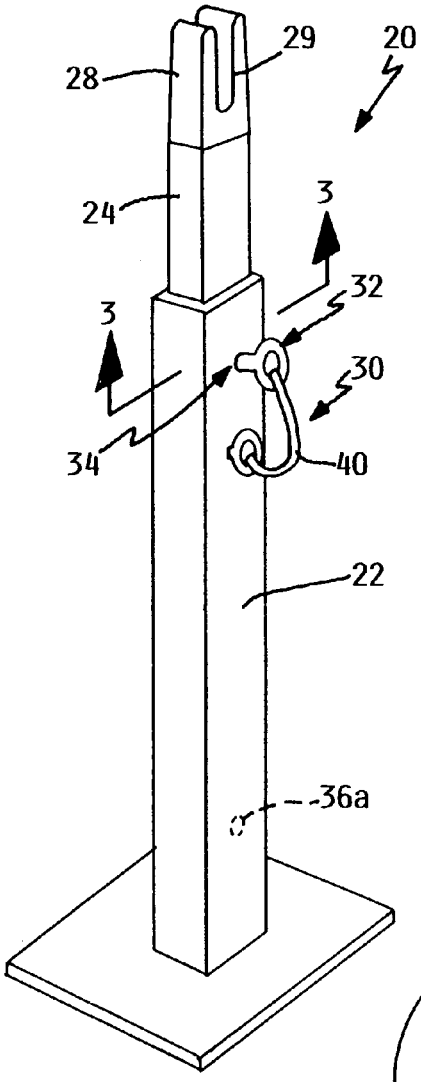
FIG. 2 is a perspective view of the singles stick shown in FIG. 1, particularly illustrating the singles stick in it's collapsed storage position.

A first embodiment of an improved singles stick according to this invention is shown in FIG. 1 generally as 20. Singles stick 20 is made of two telescopic sections comprising a base 22 that telescopically receives an upper staff 24. Base 22 is hollow over most of its length so that upper staff 24 can slide down into base 22 when singles stick 20 is in a collapsed storage position as shown in FIG. 2. However, when in the collapsed storage position shown in FIG. 2 and when upper staff 24 bottoms out in base 22, a small length of upper staff 24 still sticks up out of base 22. This allows the user to grab upper staff 24 to pull upper staff 24 up out of base 22 to place singles stick 20 into an extended operating position.

Figure 3:
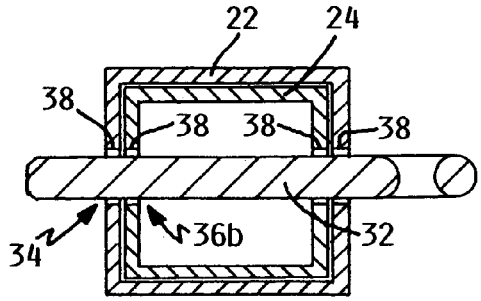
FIG. 3 is a cross-sectional view of the singles stick shown in FIG. 1, taken along lines 3—3 in FIG. 2.

Base 22 and upper staff 24 have mating cross-sectional shapes to allow the two sections to smoothly telescope relative to one another. For example, as shown in FIGS. 1–3, both base 22 and upper staff 24 can comprise pieces of hollow, square tubing with the tubing forming upper staff 24 being sized to be slightly smaller than the tubing forming base 22. The bottom of the tubing forming base 22 is attached to an enlarged foot 26 that can engage the surface of court 2 when singles stick 20 is in use, though foot 26 can be dispensed with if so desired with the bottom end of base 22 simply engaging against the surface of court 2.

Obviously, the square tubing shown forming base 22 and upper staff 24 of singles stick 20 can be changed to other shapes, such as circular or hexagonal tubing. In addition, base 22 and upper staff 24 of singles stick 20 need not have mating shapes as along as the two can extend and retract relative to one another in a sliding fashion. While a telescopic fit between base 22 and upper staff 24 is a convenient type of sliding connection, base 22 and upper staff 24 could be slidably connected together in other ways.

Base 22 and upper staff 24 can be made of any suitable materials, such as being formed of metallic or plastic tubing. Upper staff 24 has a notched portion 28 for engaging beneath net cable 11 as shown in FIG. 1. Notched portion 28 can be formed integrally with staff 24 or can be made, as shown in FIGS. 1–3, as a separate piece fixedly attached to the rest of staff 24. When notched portion 28 is a separate piece, it can be made of a relatively stiff rubber material to avoid abrading net cable 11. Similarly, foot 26 on base 22 can be made of the same type of rubber material to avoid the potential of scuffing or marring the surface of court 2.

Base 22 and upper staff 24 can be locked together in one of two distinct positions of singles stick 20. In the first position, shown in FIG. 1, upper staff 24 is pulled or extend up out of base 22 and the two sections are locked together to retain upper staff 24 and base 22 in this extended position. In this extended position, the combined length of base 22 and upper staff 24, measured from the bottom of foot 26 to the bottom of notch 29 in notched portion 28, will be 42 inches, i.e. the length singles stick 20 must have to convert court 2 to regulation singles play. Thus, when singles stick 20 is installed as shown in FIG. 1 at just the right distance from the singles line, singles stick 20 can be placed between the surface of court 2 and net cable 11 and raise net cable 11 just the right amount to convert court 2 to regulation singles play.

The second position of singles stick 20 is shown in FIG. 2 and comprises a collapsed position in which upper staff 24 has been slid down into hollow base 22. Again, base 22 and upper staff 24 can be locked together in this position. When base 22 and upper staff 24 are placed into the collapsed storage position of singles stick 20, their combined length will now be short enough to allow singles stick 20 to be conveniently dropped into the usual equipment bag used by tennis players to carry their rackets and the like. For example, in its collapsed position, the single stick will be somewhat less than 30 inches long, whereas it is 42 inches long in its extended position.

Any suitable lock 30 can be used to lock base 22 and upper staff 24 together. As shown in FIGS. 1–3, one lock 30 that can be used is a locking pin 32 inserted through sets 34 and 36*a*, 36*b* of aligned holes 38. Preferably, as shown in FIG. 3, locking pin 32 is attached to the outside of base 22 by a tether 40 so that it will not be lost or misplaced.

The upper end of base 22 includes a first set 34 of aligned holes 38 in opposite sides of base 22. Upper staff 24 has two sets 36*a* and 36*b* of similar holes 38. The first set 36*a* is located adjacent the bottom of upper staff 24 and the second set 36*b* is located adjacent the top of upper staff 24 beneath notched portion 28. Singles stick 20 will have be placed in its extended operating position or its retracted storage position depending upon which set 36 of holes in upper staff 24 is aligned with the set 34 of holes in base 22 before locking pin 22 is inserted through the aligned holes.

For example, in FIG. 1, locking pin 32 is inserted through the set 34 of holes in base 22 and through the first set 36*a* of holes in upper staff 24. This locks singles stick 20 in its extended operating position. The second set 36*b* of holes in upper staff 24 can be seen in FIG. 1 as they are exposed in the position of singles stick 20 that is illustrated in FIG. 1.

Figure 4:
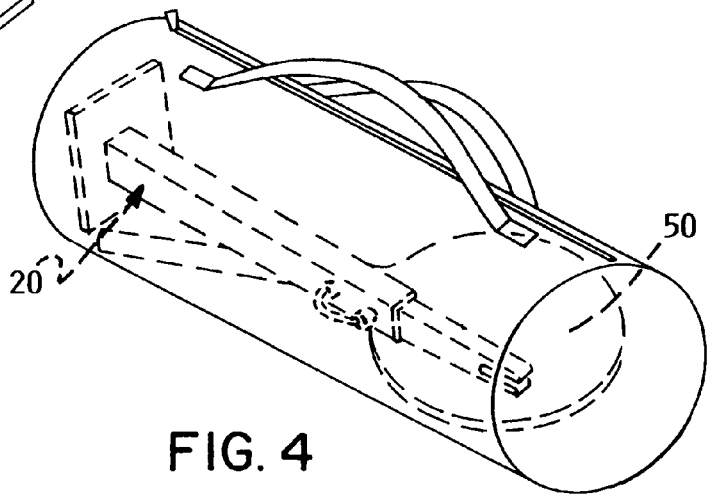
FIG. 4 is a perspective view of the singles stick shown in FIG. 1, particularly illustrating the singles stick in its collapsed storage position and with the singles stick being carried inside an equipment bag of the type often used by tennis players to carry tennis rackets.

If one wishes to collapse singles stick 20 and place it in its collapsed storage position, locking pin 32 is first withdrawn from its locking position as shown in FIG. 1. Upper staff 24 will then collapse or fall down into base 22. When upper staff 24 is fully collapsed into base 22, the second set 36*b* of holes on upper staff 24 will be automatically aligned with the set 34 of holes on base 22. Locking pin 32 can then be reinserted through these sets 34 and 36*b* of holes, as shown in FIG. 2, to lock singles stick 20 in its collapsed storage position. In this position, singles stick 20 can be received in the equipment bag and will not inadvertently extend within the bag. FIG. 4 shows singles stick 20 inside such a bag next to a typical tennis racket 50.

Figure 5:
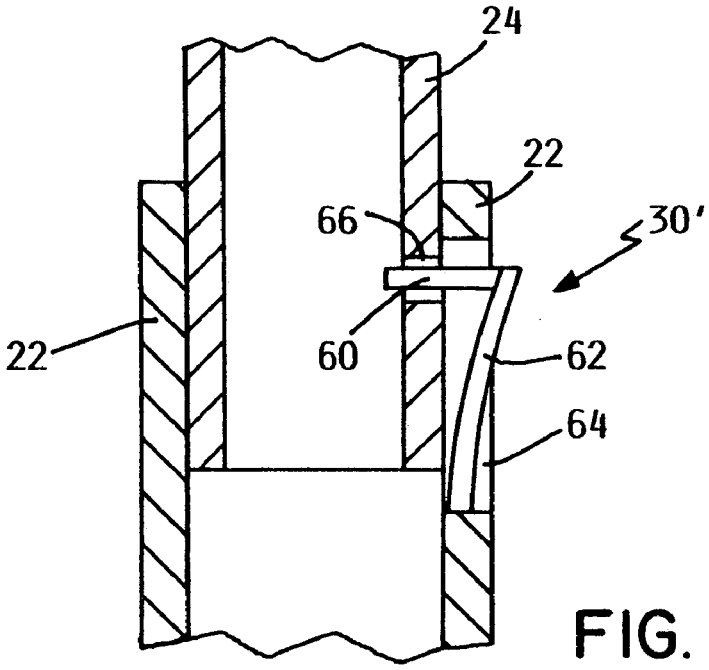
FIG. 5 is a partial cross-sectional view of a second embodiment of a singles stick according to this invention, particularly illustrating a different lock for locking the singles stick in its extended operating position.

Any suitable lock can be used in place of the locking pin/aligned hole structure shown herein. For example, referring to the embodiment of singles stick 20 shown in FIG. 5, lock 30' can comprise a relatively short locking pin 60 carried at the top of a spring biased finger 62 located in a slot 64 in the top of base 22. Finger 62 can comprise a flexible piece of spring steel or the like which is biased inwardly due to the flexible nature of the material and how finger 62 is mounted in slot 64. Locking pin 60 will engage within one of two vertically spaced holes 66 (only one of which is shown in FIG. 5) in upper staff 24 to lock singles stick 20 in its extended operating position or in its collapsed storage position. FIG. 5 shows locking pin 60 in engagement with the hole 66 adjacent the bottom of upper staff 24 for locking singles stick 20 in its extended operating position.

In using lock 30' shown in FIG. 5, the operator can grip finger 62 with the operator's fingers and pull outwardly on finger 62 to withdraw locking pin 60 from whatever hole 66 it currently is received in. Then, singles stick 20 can be extended or collapsed, as the case may be, until the other hole 66 becomes aligned with locking pin 60. Then, the operator can release finger 62 and the natural bias on finger 62 will cause locking pin 60 to be inserted through the aligned hole 66.

Figure 6:
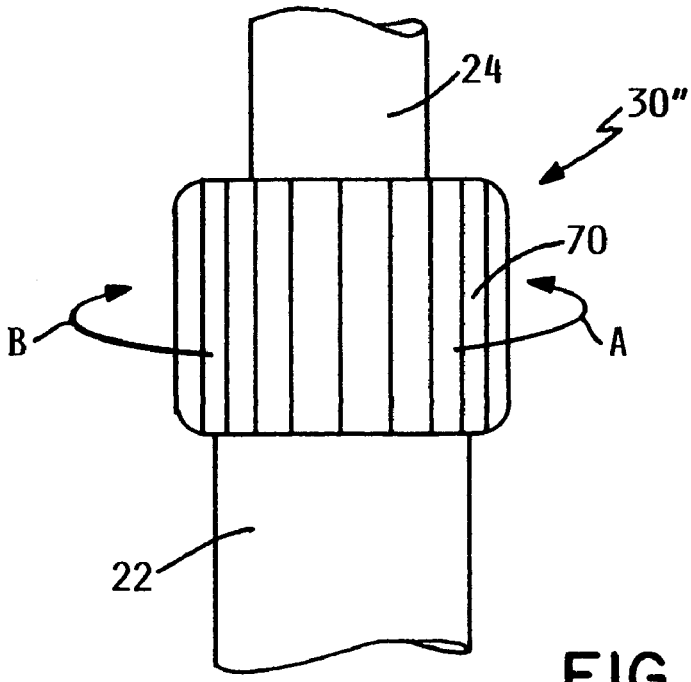
FIG. 6 is a partial side elevational view of a third embodiment of a singles stick according to this invention, particularly illustrating yet a different lock for locking the singles stick in its extended operating position.

Referring now to FIG. 6, yet another embodiment of a singles stick according to this invention is illustrated having yet a different lock 30'. In this embodiment, both upper staff 24 and base 22 are formed as pieces of circular tubing. At the point where upper staff 24 enters base 22, a rotatable locking knob 70 of the type used on microphone or music stands is used. The construction of such knobs 70 is well known. In any event, upper staff 24 and base 22 can be locked together by turning locking knob 70 in a counterclockwise direction as illustrated by the arrow A in FIG. 6, and can be unlocked from one another by turning locking knob 70 in the opposite clockwise direction as illustrated by the arrow B in FIG. 6.

In using a locking knob 70 of the type shown in FIG. 6, it is desirable that there be some detent or some means for defining the proper positions of the upper staff 24 and base 22 when they reach the extended operating position thereof to avoid having to measure when this position is reached. Thus, the top of base 22 could be formed with an inwardly turned lip (not shown) that would cooperate with an outwardly turned shoulder (not shown) on upper staff 24 to limit how far the upper staff 24 can be extended up out of base 22. When the lip and shoulder engage with one another, the overall length of singles stick 20 in its extended operating position will be exactly correct. At this point, the operator can rotate locking knob 70 to lock singles stick 20 in its extended operating position.

Other locks could also be used in place of those shown in FIGS. 1–6. For example, upper staff 24 could be formed with grooves in place of the locking holes 38 for receiving an inwardly biased ball detent carried on base 22. Locks that are carried inside the base 22 and upper staff 24 could also be used, such as the locks used to lock shower rods in an extended position. While various locks could be used, a lock which can be released and engaged by hand is preferred.

Moreover, while it is also preferred to use a lock 30 that can lock singles stick 20 in both its extended and collapsed positions, it is only necessary that lock 30 be able to lock singles stick 20 in its extended operating position to prevent the tension in net cable 11 from inadvertently collapsing singles stick 20. Thus, only the first set 36*a* of locking holes 38 on upper staff 24 is strictly necessary.

The advantages of singles stick 20 of this invention are apparent. For one thing, in its collapsed storage position, it easily fits into a tennis player's equipment bag to be easily transportable along with the rest of the tennis player's equipment. Once the tennis player arrives at court 2, singles stick 20 can be quickly and easily removed, unlocked, pulled out into its extended operating position, relocked, and then placed beneath net 10 between court 2 and net cable 11. To assist in this placement, a measurement mark 44 can be located along upper staff 24 to assist the user in measuring the correct location of singles stick 20 from singles line 6.

In addition, singles stick 20 of this invention is more easily installed and used than sticks that are made of separate sections that have to be assembled end to end. For example, base 22 and staff 24 remain connected to one another, i.e. staff 24 is at least partially within base 22, as the two parts move between their collapsed and extended positions. While one could theoretically lift staff 34 all the way up and out of base 22, there is no reason to do this and the parts will normally stay in telescopic engagement with one another. Thus, it is not likely that either base 22 or staff 24 will be lost. Moreover, once singles stick 20 is placed in its locked, extended operating position, it will not collapse if inadvertently struck by a tennis ball.

Various modifications of this invention will be apparent to those skilled in the art. For example, singles stick 20 could be made of more than two telescopic sections if so desired, but a lock would have to be provided between each of the adjacent telescopic sections to prevent inadvertent collapsing or shortening of singles stick 20 during use. Accordingly, it is preferred that only two sections be used to form singles stick 20 so that only one lock 30 is needed. Thus, the scope of this invention is to be limited only by the appended claims.

I claim:

1. A singles stick for holding the top edge of a tennis net at its regulation height above the ground for singles play, which comprises:

(a) a base comprising a single, rigid, fixed length piece having a bottom for engaging the ground and an upper end spaced above the ground when the bottom of the base engages the ground;

(b) a staff slidably connected to the base such that the base and staff can be pulled apart or pushed together between collapsed and extended positions thereof by sliding the base and staff relative to one another, wherein the staff comprises a single, rigid, fixed length piece having a bottom and a top, wherein the bottom of the staff is adjacent the upper end of the base when the base and staff are disposed in the extended position thereof, and wherein the base and staff are the only two pieces that slide relative to one another to vary the length of the singles stick;

(c) a notch on the top of the staff with the notch having an upwardly facing bottom, wherein a top support cord or cable of a tennis net can be placed within the notch and when so placed the top support cord or cable rests against and is retained against vertical movement by the bottom of the notch;

(d) a lock which releasably secures the base and staff against sliding movement relative to one another when the lock is engaged, wherein the lock is configured to hold the base and staff in a predetermined, extended and locked position by acting between a location on the staff which is adjacent to the bottom of the staff and a location on the upper end of the base after the staff has been slid relatively to the base to raise the bottom of the staff to a position adjacent the upper end of the base; and (e) wherein the combined length of the base and staff in the predetermined, extended and locked position of the base and staff is selected to hold the top edge of the tennis net above the ground by an amount required to conform the tennis net for regulation singles play when the singles stick is installed at a predetermined court location between a singles line and doubles line on one side of a tennis court, wherein a user can quickly and easily conform one side of the tennis net for regulation singles play without measurement by pulling the base and staff of the singles stick apart, by locking the base and staff of the singles stick together in the predetermined, extended and locked position that is provided therefor, and by then wedging the singles stick between the top support cord or cable and the ground at the predetermined court location, the singles stick when so wedged having the top cord or cable of the tennis net resting against the bottom of the notch on the staff with the bottom of the base resting against the ground.

2. The singles stick of claim 1, wherein the base and staff are telescopically connected to one another.

3. The singles stick of claim 2, wherein the base and staff have mating non-circular cross-sectional configurations.

4. The singles stick of claim 1, wherein the bottom of the base comprises an enlarged foot for abutting against the ground.

5. The singles stick of claim 1, wherein the lock is further configured to hold the base and staff in a predetermined, collapsed and locked position.

6. The singles stick or claim 1, wherein the lock comprises a locking pin insertable in a hole when the lock is engaged.

7. The singles stick of claim 6, wherein the pin is spring biased in a direction tending to insert the pin in the hole when the pin is aligned with the hole.

8. The singles stick of claim 1, wherein the lock is biased towards automatic engagement of the lock.

9. The singles stick of claim 1, wherein the base has an elongated tubular shape without any ground engaging, vertically extending support legs being carried on the base.

10. The singles stick of claim 1, wherein the combined length of the base and staff in the collapsed position thereof is substantially as long as a tennis racket to allow the singles stick formed by the base and staff in the collapsed position thereof to be short enough to be laid lengthwise in an equipment bag that is sized to carry a tennis racket that is also laid lengthwise within the equipment bag but with the singles stick remaining long enough when the base and staff are in the collapsed position to be easily visible and locatable within the equipment bag.

* * * * *